United States Patent [19]

Buttenschon

[11] 3,939,511

[45] Feb. 24, 1976

[54] LIFE-SAVING DEVICE

[76] Inventor: Ove Hviding Buttenschon, Vestervangen 23, DK-4550 Asnaes, Denmark

[22] Filed: Jan. 16, 1974

[21] Appl. No.: 433,785

[30] Foreign Application Priority Data

Jan. 17, 1973 Denmark ..... 271/73

[52] U.S. Cl. ..... 9/342; 9/333

[51] Int. Cl.² ..... B63C 9/08

[58] Field of Search ..... 9/14, 301, 311–312, 9/329–330, 333, 336–342

[56] References Cited

UNITED STATES PATENTS

| | | | |
|---|---|---|---|
| 993,402 | 5/1911 | Prescott | 9/339 |
| 1,167,930 | 1/1916 | Rasmussen | 9/342 |
| 1,182,841 | 5/1916 | Edmonds | 9/333 |
| 1,295,667 | 2/1919 | Ziman | 9/333 |
| 1,704,368 | 3/1929 | Murphy | 9/342 |
| 2,331,301 | 10/1943 | Brown | 9/342 |

FOREIGN PATENTS OR APPLICATIONS

| | | | |
|---|---|---|---|
| 32,234 | 4/1921 | Norway | 9/333 |

*Primary Examiner*—George E. A. Halvosa
*Assistant Examiner*—Jesus D. Sotelo
*Attorney, Agent, or Firm*—Robert E. Burns; Emmanuel J. Lobato; Bruce L. Adams

[57] ABSTRACT

A life-saving device, such as a life vest or safety vest, comprising two superimposed flexible sheet members sandwiching a number of buoyancy or float members therebetween. The buoyancy members are positioned in transversely extending pockets and are preferably sealed hollow cylindrical bodies made from plastic material. The life-saving device preferably shows a substantially rectangular outline and a neck opening so that it may be worn like a cape with a front part which may be positioned either in an extended hanging position, or in a position in which it is folded and arranged in front of the user's breast.

3 Claims, 4 Drawing Figures

LIFE-SAVING DEVICE

BACKGROUND OF THE INVENTION

1. Field of the Invention.

The present invention relates to a life-saving device, such as a life vest or safety vest.

2. Description of Prior Art.

The known life-saving devices of the type adapted to be worn by an individual user may be divided into three general main groups, namely the type wherein a light, porous and flexible material, such as foamed plastic material or fibrous material, is used as buoyancy means, the type having a number of relatively rigid float bodies, and the inflatable type. A life vest or life jacket of the first mentioned type may be relatively comfortable to use, but most of them are not effective in keeping the head of an unconscious user above the water surface, and furthermore, these prior art life-saving devices loose their effectiveness in case the cover enclosing the buoyancy means is punctured. The known life vests of the inflatable type are comfortable to wear in their uninflated condition, but they also become ineffective if punctured. Life vests or safety vests of the type having relatively stiff float members are the most reliable. However, they are very uncomfortable to wear so that yachtsmen and other persons who ought to wear safety vests as a precaution are tempted not to do so.

SUMMARY OF THE INVENTION

The present invention relates to a life-saving device of the type to be worn by an individual user and comprising a flexible breast portion adapted to be positioned on the user's breast, said breast portion including a flexible sheet material and a number of buoyancy or float members arranged thereon, a lower part of said device being adapted to depend in front of the user's stomach and thighs in a first position and to be folded up in front of the user's breast in a second position, said lower part having means for securing the same in said second position.

The life-saving device may be formed as a cape having a neck opening and may be foldable along a relatively high number of transversely extending lines or zones between the float members and thus almost have form of an articulated belt or band. Therefore, when the said lower part of the device is in its hanging, first position the device according to the invention does not hamper the movement of the user to any substantial extent even when he doubles himself up. In case a dangerous situation occurs the user may move the said lower part of the device to its folded second position in front of the user's breast and fasten it in that position. Thereby the center of buoyancy is moved upwardly and nearer to the head of the user so that — if he falls into the water — his face will be kept better above the water surface even if he is unconscious. It is understood that by means of the life-saving device according to the invention it is possible to obtain a rather high buoyancy effect with an advantageously positioned buoyancy center, and despite of this the life-saving device is relatively comfortable to wear when the said lower part thereof is in the said first position in front of the user's stomach and thighs.

The buoyancy or float members may be fastened to the flexible sheet material in any suitable manner. Preferably, the buoyancy of float members are arranged in pockets or chambers defined between two oppositely arranged flexible sheet members whereby a reliable and simple fastening of the float members is obtained. These pockets or chambers may advantageously be defined between substantially equidistant, transversely extending seams connecting the sheet members together. Thereby an especially simple embodiment is obtained which may be produced very rationally as explained more in detail in the following. It should be understood that the said seams may be made in any suitable manner, for example by sewing, heat-sealing, or glueing.

The buoyancy members or float members are preferably shaped as circular cylinders, and they may then be arranged rather close to each other and separated only by relatively narrow seams or zones without preventing bending or folding of the device along these zones. The buoyancy or float members may be made from any of the traditionally used materials, e.g. foamed plastic material. An improved buoyancy is, however, obtained by using hollow sealed bodies of plastic material. Such hollow bodies of plastic have previously not been commonly used, because they become completely ineffective in case they are accidentally punctured. In the device according to the invention that risk is of less importance because the life-saving device according to the invention may contain a relatively large number of separate float members so that puncturing of one or a few of the float members will not reduce the efficiency of the device to any substantial degree.

The safety device according to the invention may comprise means for fastening an intermediate portion thereof to the user's waist and means for fastening the free end of the lower part of the device to the user's neck when the device is folded in front of the user's breast. The neck fastening means may for example have form of a loop which may easily be passed over the head of the user even when he has already falled into the water. Both when the life-saving device according to the invention is worn with its lower part hanging freely down and when the device is worn in a folded position as just explained the user's freedom of movement may be still improved by arranging the buoyancy or float members substantially symmetrically in relation to the longitudinal center line in such a manner that the life-saving device is bendable or foldable along that center line.

In general the life-saving device according to the invention may have any suitable outline. However, the device or safety vest has preferably a substantially rectangular or a similar elongated shape.

The present invention also relates to a method for producing a life or safety vest, said method comprising superimposing two webs of flexible sheet material, fastening said webs together along transversely extending seams so as to define tansverse pockets or chambers therebetween, cutting elongated sections from said webs along transverse cuts, cutting a neck opening in each of said sections, positioning buoyancy or float members in said transverse pockets, and providing each of said sections with fastening means for fastening the same to a user. The neck openings may be cut before, after, or simultaneously with the cutting of the respective elongated section from which a safety vest is being formed. The buoyancy or float members are preferably placed in the transverse pockets after forming of the same before or after cutting of the respective elongated section from the superimposed webs, and the pockets or chambers defined between the transverse seams may then be totally closed by a subsequent sealing operation. However, it is also possible to position the buoyancy or float members in the desired pattern sandwiched between the superimposed webs before they are fastened to each other along zones not being overlapped by the buoyancy or float members. It is understood that by the method according to the invention it is possible to produce a life or safety vest in a very rational and economic manner suitable for mass production.

According to the invention one or more of the transverse pockets or chambers transversely aligned with the neck opening may be left free of buoyancy or float members in order to provide a transversely extending flexible zone adapted to be supported by the shoulders of the user and thus forming a boundary between front and back portions of the vest. The provision of such thin flexible shoulder zones makes the vest more comfortable in use.

BRIEF DESCRIPTION OF THE DRAWINGS

The invention will now be described more in detail with reference to the drawings wherein.

DESCRIPTION OF THE PREFERRED EMBODIMENT

Figure 1:
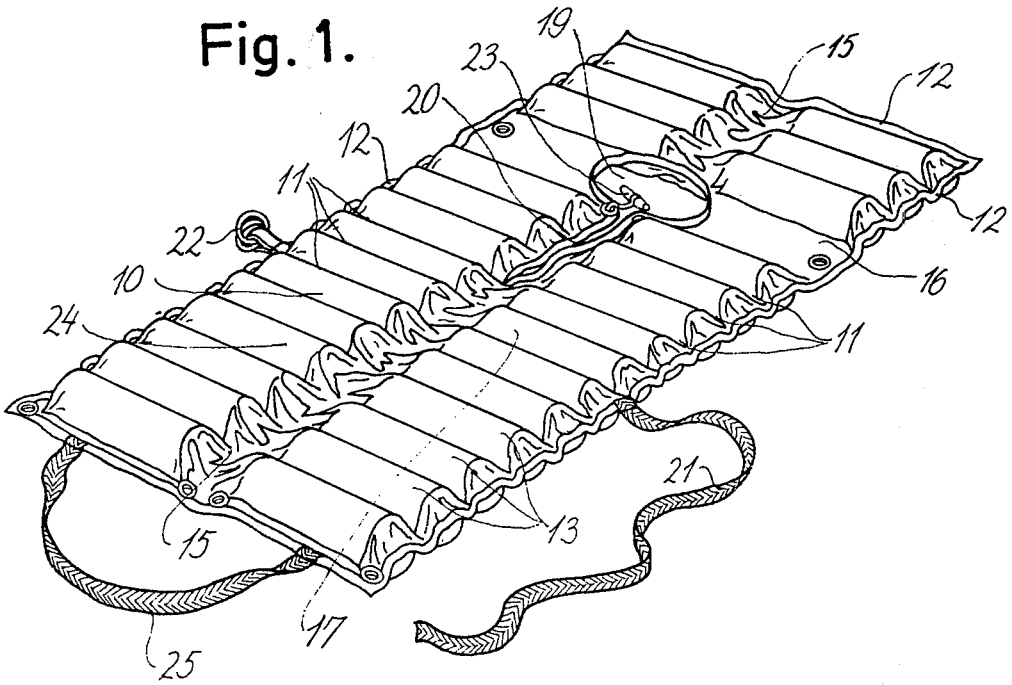
FIG. 1 shows an embodiment of the life vest or safety vest according to the invention.

The life vest or safety vest shown in FIG. 1 is made from two substantially rectangular sheet members 10 of a waterproof film or fabric material which is sewn, heat-sealed or in any other manner fastened to each other along a number of substantially equidistant, transversely extending seams 11 defining a number of substantially parallel, elongated, transverse chambers or pockets 13. Each of these pockets receives two cylindrical, hollow float members or bodies 14 spaced in such a manner that a longitudinally extending flexible zone 15 is formed along the longitudinal center line of the vest. The pockets or chambers are closed by edge seams 12. The safety vest also has a transversely extending flexible zone 16 formed by one or more empty chambers or pockets 13 dividing the vest into a relatively long breast portion intended to be positioned in front of the breast of a user, and a relatively short back portion intended to engage the back of the user or the back of his head. A neck opening 19 is cut at the central portion of the transversely extending zone 16, and in the embodiment shown the neck opening comprises a slit 20 extending a short distance along the longitudinal center line of the vest. It is understood that when the vest is worn by a user the transversely extending zone 16 will be supported by the shoulders of the user.

Figure 2:
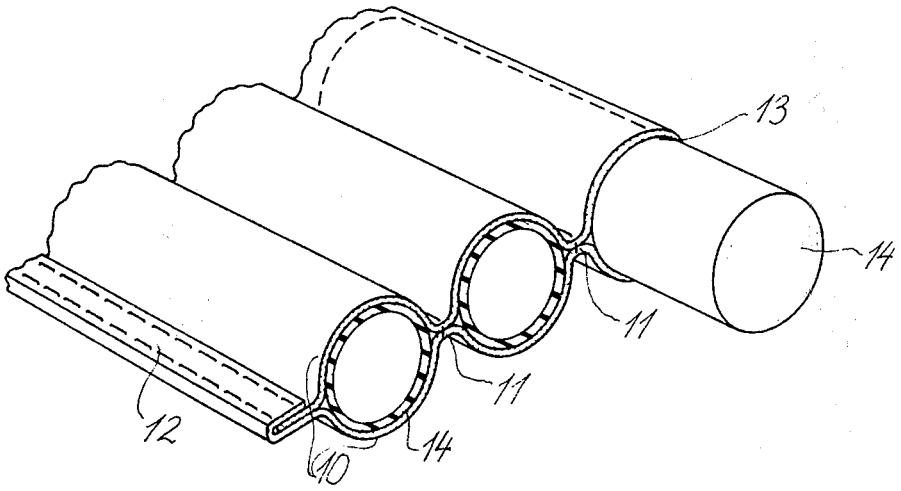
FIG. 2 shows in enlarged scale a fragment of the safety vest shown in FIG. 1.
Figure 3:
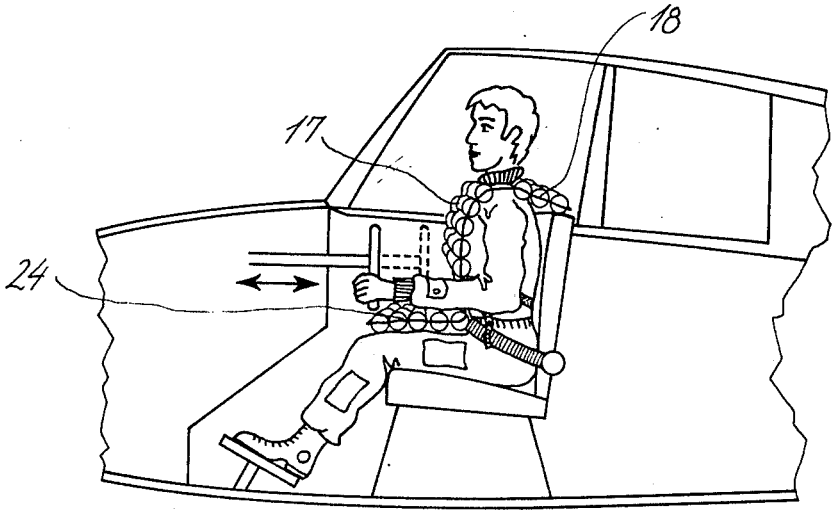
FIG. 3 shows a pilot wearing the safety vest.
Figure 4:
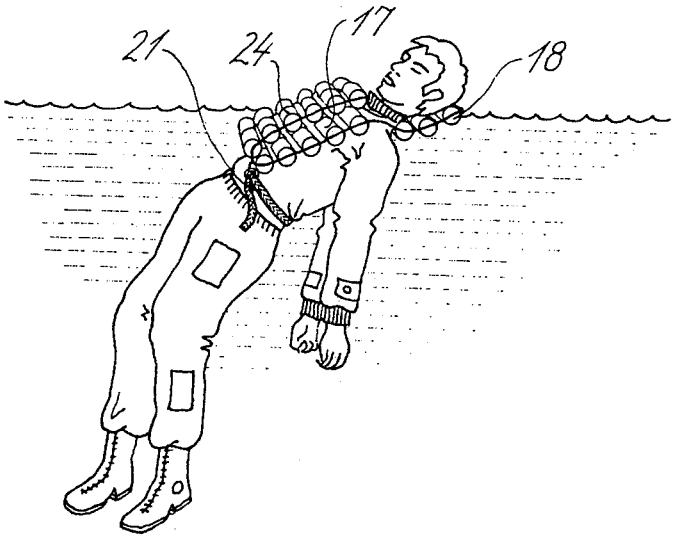
FIG. 4 shows the pilot lying in the water in an unconscious condition.

When a user puts on the life or safety vest shown in FIG. 1 he passes his head through the neck opening 19, 20 and positions the vest in such a manner that the transversely extending zone 16 engages his shoulders as just described. The back portion 18 hangs down along the user's back like a sailor's collar whereas the breast portion 17 covers his breast with its lower free end portion hanging down in front of the user's thighs. The user now fastens the vest to his body by means of a waist strap or band 21 and a buckle 22 or a similar fastening device, and closes the slit 20 by means of closing members 23 arranged at the upper end of the slit. When it is important that the user of the life or safety vest has his full freedom of movement the vest may be worn in the manner described with the lower free end portion of the breast portion 17 hanging freely like an apron 24. FIG. 3 shows an example where a pilot wears a safety or life vest of the type shown in FIGS. 1 and 2. In that case it is important that the vest does not hamper the pilot's movements or fill so much that the backward and forward movements of the control column is prevented or hampered. If the risk that the user of the vest falls into the water is increased, or in case he has already fallen into the water the breast portion 17 is bended or folded along one of the transverse seams 11 adjacent to the waist strap 21, and a loop 25 fastened to the free end of the breast portion 17 or apron 24 is passed over the head of the user. Thereby the position of the boyancy center will be such that the user will automatically be placed with his face upwards and his head above the water surface even if he is unconscious. That situation is illustrated in FIG. 4. It is noted that the back portion 18 will place itself under the back of the user's head like a pillow and thus tend to push the head forwards and up from the water surface.

It should be understood that the embodiment shown on the drawings may be modified in various respects within the scope of the present invention. Thus, for example the boyancy or floating members which may be made of any suitable material such as foamed plastics, need not have a circular cross section but may have any other cross-sectional shape such as triangular, rectangular, or trapezoidal. Even though it is advantageous from a manufacturing point of view, the pockets or chambers 13 and the float members 14 received therein need not necessarily all be of the same size or shape. It should also be noted that the life or safety vest need not have a rectangular outline as shown on the drawings. For example, the corners of the vest may be rounded, or the vest may have any other suitable elongated outline. Furthermore, the slit 20 may extend down to the lower free end of the breast portion 17, and the closing members 23 may then for example be replaced by a zip fastener.

I claim:

1. A life preserver comprising:

a flexible apron-like portion, a substantially shorter flexible head-supporting portion, and a flexible intermediate region intermediate said portions, said portions having two rows of transversely extending elongated narrow longitudinally spaced pockets along the entire length thereof, said pockets in said two rows being laterally disposed and laterally spaced in end-to-end relationship and being axially spaced from each other sufficiently to define therebetween a flexible central region of each of said portions, said flexible intermediate region having a head receiving opening for receiving the head of a user therein, said head-supporting portion overlying the shoulders of said user when in use out of the water and said apron-like portion overlying the chest of the user when in use and extending below the waist of said user down to his thighs out of the water;

a plurality of generally cylindrical buoyant members each in a respective one of said pockets to impart buoyancy to said portions, said apron-like portion being flexible for flexing at intervals between said pockets containing said buoyant members for conforming in shape to the body of said user when said user changes position or posture out of the water and for being reversibly foldable at about the waist of said user to allow the reversely folded part to be selectively positioned overlying that part of said apron-like portion overlying the chest of the user, said head-supporting portion being flexible for freely floating away from said user's shoulders in the water and for underlying and supporting said user's head above the water; and means for holding the reversely folded part in a folded condition overlying that part of said apron-like portion overlying the chest of the user.

2. A life preserver according to claim 1, in which said flexible central region comprises a slit extending from said opening and terminating remotely from the end of the panels remotest from said opening, and including means to selectively close and open said slit.

3. A life preserver comprising:

two opposed generally elongated, rectangular panels of flexible material having a major longitudinal dimension and a minor transverse dimension and secured to each other along the boundary thereof, a plurality of transverse substantially equidistantly spaced seams of said panels defining two rows of transversely extending narrow and elongated longitudinally spaced pockets defined by the opposed panels and extending transversely of the major dimension of said panels, said pockets in said two rows being laterally disposed and laterally spaced in end-to-end relationship and being axially spaced from each other sufficiently to define therebetween a flexible central region extending longitudinally the entire length of said opposed panels, said panels having a transverse zone closer to one end of the major dimension of said panels and having an opening for receiving therethrough the head of a user, said flexible central region comprising a slit extending from said opening and terminating remotely from the end of the panels remotest from said opening;

a plurality of generally cylindrical buoyant members, ones of said buoyant members disposed in respective ones of the pockets between said transverse zone and said end to define a flexible buoyant head-supporting portion overlying the shoulders of the user when in use out of the water and for freely floating away from the user's shoulders when in use in the water to underlie the user's head and support it above the water, the remainder of said buoyant members disposed in respective ones of the pockets between said transverse zone and the other end of the major dimension of said panels to define a flexible buoyant apron-like portion overlying the chest of the user, said panels having a length whereby said apron-like portion extends below the waist of the user to the thighs of the user when in use out of the water, said apron-like portion being flexible for flexing at intervals between said pockets containing said buoyant members for conforming in shape to the body of the user when the user changes position or posture out of the water and for being reversibly foldable at about the waist of the user to allow the reversely folded part to be selectively positioned overlying that part of the apron-like portion overlying the chest of the user;

means for holding the reversely folded part in a folded condition overlying that part of the apron-like portion overlying the chest of the user; and means for selectively closing and opening said slit.

* * * * *